US009486392B2

(12) United States Patent
Kemper et al.

(10) Patent No.: US 9,486,392 B2
(45) Date of Patent: Nov. 8, 2016

(54) INFANT BOTTLE ASSEMBLY HAVING A VENTED NIPPLE

(71) Applicant: Handi-Craft Company, St. Louis, MO (US)

(72) Inventors: Bernard J. Kemper, Bonne Terre, MO (US); Steve Simmons, St. Louis, MO (US); Charles H. Miller, St. Louis, MO (US)

(73) Assignee: Handi-Craft Company

( * ) Notice: Subject to any disclaimer, the term of this patent is extended or adjusted under 35 U.S.C. 154(b) by 0 days.

(21) Appl. No.: 14/620,396

(22) Filed: Feb. 12, 2015

(65) Prior Publication Data

US 2015/0231036 A1 Aug. 20, 2015

Related U.S. Application Data

(60) Provisional application No. 61/941,788, filed on Feb. 19, 2014.

(51) Int. Cl.

| | |
|---|---|
| ***A61J 11/02*** | (2006.01) |
| ***A61J 11/00*** | (2006.01) |
| ***A61J 11/04*** | (2006.01) |

(52) U.S. Cl.

CPC ..... *A61J 11/02* (2013.01); *A61J 11/0085* (2013.01); *A61J 11/045* (2013.01)

(58) Field of Classification Search

CPC .... A61H 11/02; A61H 11/0085; A61H 9/04; A61H 9/045

USPC ..... 215/11.5

See application file for complete search history.

(56) References Cited

U.S. PATENT DOCUMENTS

| | | | | |
|---|---|---|---|---|
| 2,736,446 | A * | 2/1956 | Raiche | A61J 11/02 215/11.5 |
| 3,292,809 | A | 12/1966 | Shomock et al. | |
| 5,101,991 | A * | 4/1992 | Morifuji | A61J 11/002 215/11.1 |
| 5,284,261 | A | 2/1994 | Zambuto | |
| 5,784,999 | A | 7/1998 | Larson et al. | |
| 6,994,225 | B2 * | 2/2006 | Hakim | A61J 11/0015 215/11.1 |
| 8,579,132 | B2 * | 11/2013 | Wong | A61J 9/04 215/11.5 |
| 8,733,565 | B1 * | 5/2014 | Boonprasop | A61J 11/02 215/11.1 |
| 2007/0102388 | A1 | 5/2007 | Lewis et al. | |
| 2011/0155684 | A1 | 6/2011 | Sirota | |
| 2012/0265245 | A1 | 10/2012 | Yamashita | |
| 2013/0220962 | A9 * | 8/2013 | Berkovitch | A61J 9/04 215/11.4 |
| 2013/0327737 | A1 * | 12/2013 | Lee | A61J 9/04 215/11.5 |
| 2014/0124469 | A1 * | 5/2014 | Richard | A61J 11/001 215/11.5 |

OTHER PUBLICATIONS

International Search Report and Written Opinion issued in International Application No. PCT/US2015/015338, mailed May 14, 2015.

* cited by examiner

*Primary Examiner* — Sue A Weaver

(74) *Attorney, Agent, or Firm* — Armstrong Teasdale LLP

(57) ABSTRACT

A nipple for use with a bottle assembly includes a base portion that has a bottom surface, a vent region that is coupled to and extends upward from the base portion of the nipple, and a nipple portion that extends upward from the vent region. The nipple portion includes an outlet opening therein, and the vent region includes a vent channel and an air valve substantially aligned with the vent channel.

17 Claims, 11 Drawing Sheets

INFANT BOTTLE ASSEMBLY HAVING A VENTED NIPPLE

CROSS REFERENCE TO RELATED APPLICATIONS

This application claims the benefit of U.S. Provisional Patent Application No. 61/941,788 filed Feb. 19, 2014, which is hereby incorporated by reference in its entirety.

BACKGROUND

The field of the present disclosure relates generally to bottle assemblies and more particularly to a vented nipple for a bottle assembly.

Bottle assemblies, such as infant bottle assemblies, typically have multiple components including a bottle, a nipple, a collar for securing the nipple to the bottle, and a cap for covering the nipple when the bottle is not in use. The nipple typically has one or more openings for allowing liquid contained within the bottle to exit through the nipple and into an infant's mouth for consumption by the infant (or young child). During use, the infant places an end of the nipple in their mouth and sucks on the nipple to withdraw the liquid contained within the bottle.

With some known bottle assemblies it is difficult for an infant to drink liquid such as milk from the bottle because there are no openings that enable air to enter the bottle. As an infant sucks on the bottle to remove the liquid contained therein, a vacuum is created within the bottle assembly. Air must then enter the bottle to replace the milk and relieve the vacuum pressure therein so that the milk can flow from the bottle assembly. At least some known bottle assemblies without venting features can cause the vacuum to rise to an unacceptable level causing the nipple to deform and break contact with the infant's lips, resulting in the infant swallowing air, which can be attributed to colic and spit-up in bottle-feeding infants.

At least some bottle assemblies include a removable vent assembly that can be positioned within the bottle. Some examples of vented bottle assemblies include those available from Handi-Craft Company under the trade name Dr. Brown's. In these bottle assemblies, the vent assembly allows air to enter the bottle while the infant consumes the liquid through the nipple, thus alleviating or reducing the formation of a vacuum within the bottle during nursing. The vent assembly typically seats, at least in part, on the rim of the bottle and a collar assembly including a collar and nipple are together threadably secured down over the vent assembly to external threads on the neck of the bottle.

There is a need for a vented bottle assembly, and in particular a vented bottle assembly in which the number of additional pieces is reduced and that can still be used without the risk of leakage.

BRIEF DESCRIPTION

In one aspect, a nipple for use with a bottle assembly is provided. The nipple comprises a base portion having a bottom surface, a vent region coupled to and extending upward from the base portion wherein the vent region comprises a vent channel and an air valve substantially aligned with the vent channel, and a nipple portion extending upward from the vent region and having an outlet opening therein.

In another aspect, a bottle closure assembly comprises a nipple having an outlet opening and a vent region wherein the vent region has a vent channel and an air valve defined therein. The air valve is substantially aligned with the vent channel. The bottle enclosure also includes a collar having a convex outer surface and an upper wall having a circular opening, the upper wall having an annular air vent groove defined therein.

In yet another aspect, a bottle closure assembly comprises a bottle defining a liquid chamber for holding a quantity of liquid. The bottle has a bottom, an open top, and a sidewall extending between the bottom and the open top. The sidewall has a top threaded portion defining the open top of the bottle. The bottle closure assembly also comprises a top closure assembly defining a closure for the bottle. The top closure assembly is configured for releasable engagement with the top threaded portion of the bottle over the open top thereof. The top closure assembly comprises a nipple having an outlet opening for allowing liquid held in the liquid chamber to exit the bottle assembly, and a vent region having a vent channel and an air valve substantially aligned with the vent channel for allowing air to pass into the liquid chamber of the bottle. The top closure assembly further comprises a collar having a convex outer surface and an upper wall having a circular opening. The upper wall has an annular air vent groove defined therein, wherein the vent channel is in flow communication with the air vent groove.

BRIEF DESCRIPTION OF THE DRAWINGS

Corresponding reference characters indicate corresponding parts throughout the several views of the drawings.

DETAILED DESCRIPTION OF THE DRAWINGS

Figure 1:
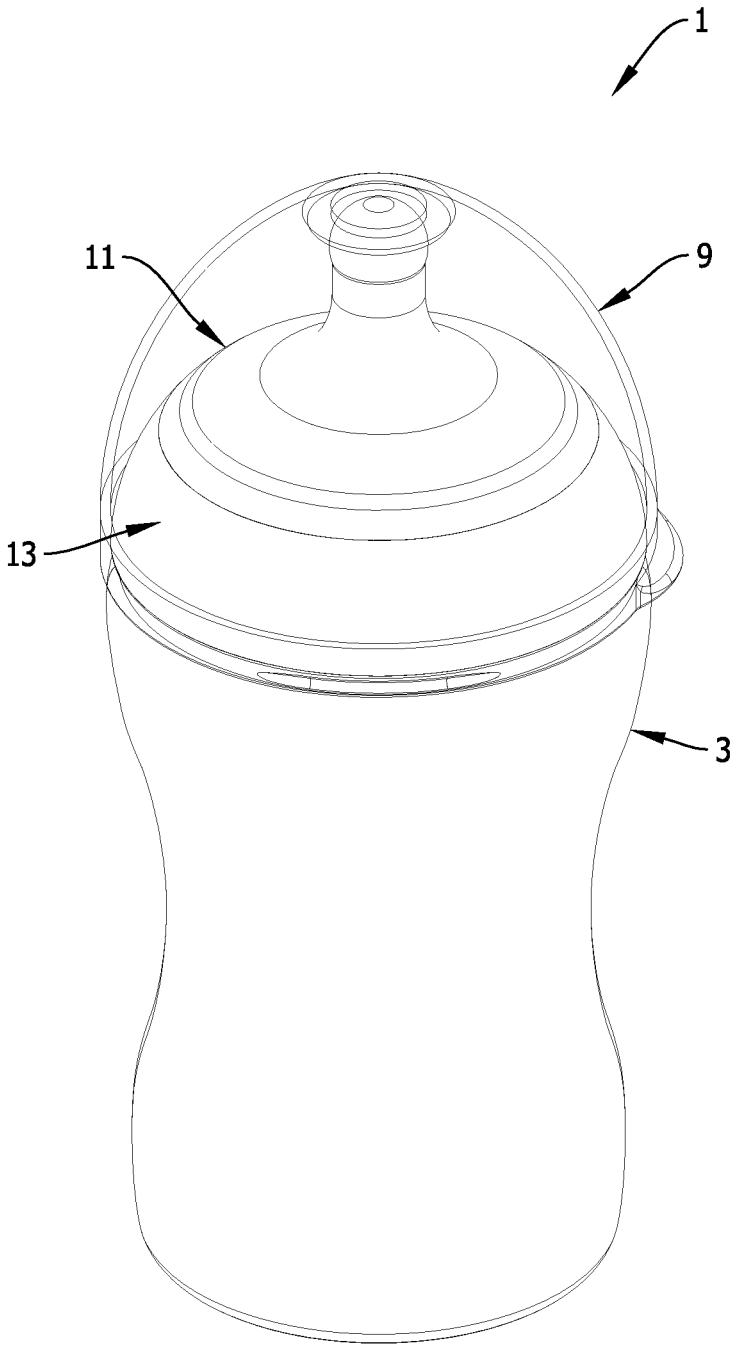
FIG. 1 is a perspective of an exemplary embodiment of a bottle assembly having a vented nipple.
Figure 2:
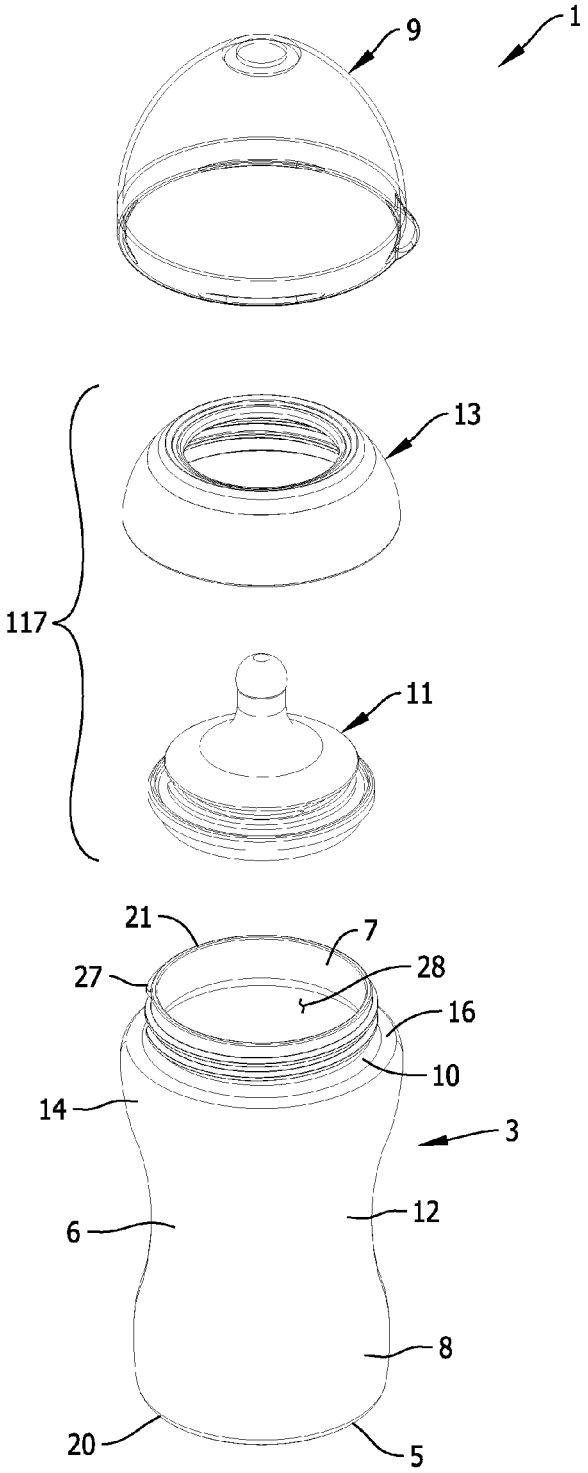
FIG. 2 is an exploded perspective of the bottle assembly shown in FIG. 1.
Figure 3:
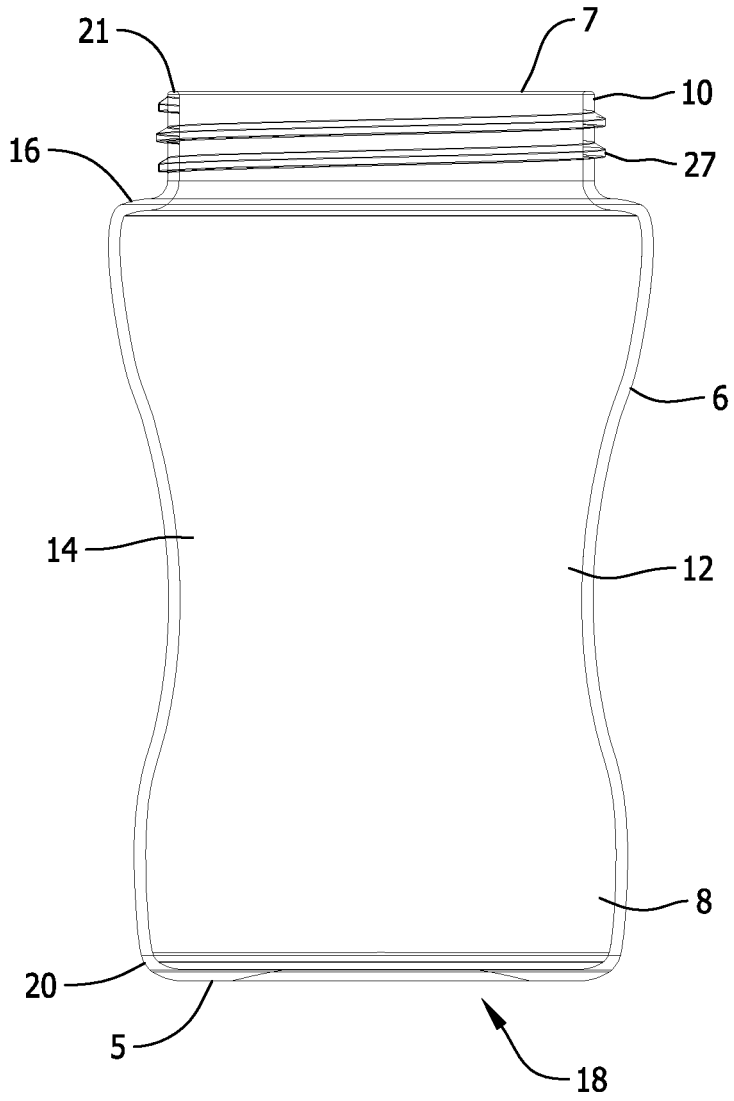
FIG. 3 is a side elevation of a bottle for use with the bottle assembly shown in FIG. 1.
Figure 4:
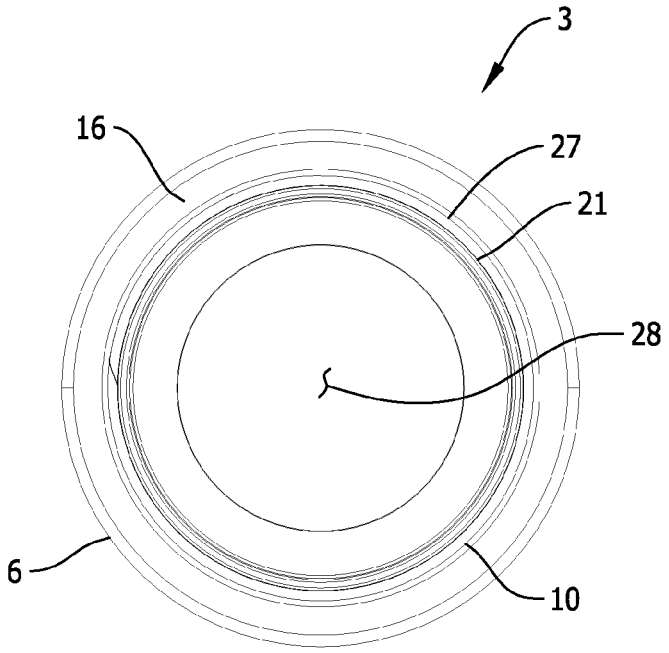
FIG. 4 is a top plan view of the bottle shown in FIG. 3.
Figure 5:
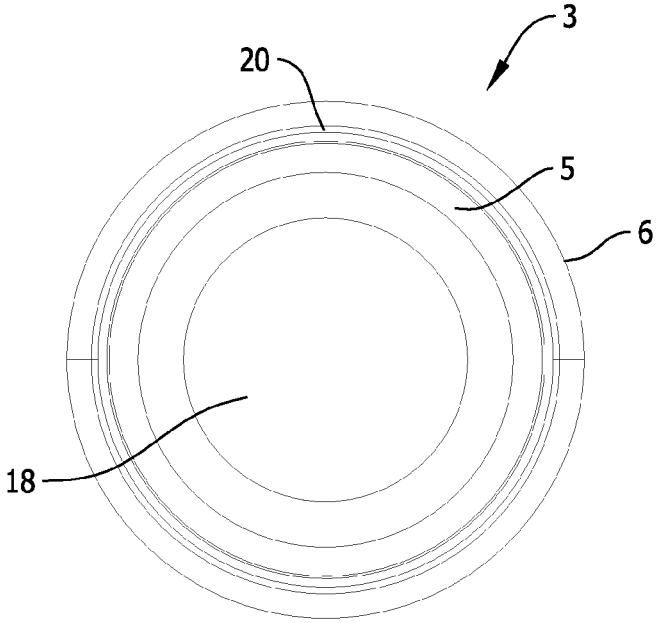
FIG. 5 is a bottom plan view of the bottle shown in FIG. 3.

Referring now to the drawings and in particular to FIGS. 1 and 2, a bottle assembly having a vented nipple is indicated generally at 1. The bottle assembly 1 comprises a bottle 3, a cover 9, a vented nipple 11, and a collar 13. Each one of the bottle 3, cover 9, nipple 11, and collar 13 are indicated generally by their respective reference number. As illustrated in FIGS. 2-5, the bottle 3 has a closed bottom 5, an open top 7, and a generally cylindrical sidewall 6 extending between the bottom 5 and the open top 7. The generally cylindrical sidewall 6 includes a base portion 8, a top threaded portion 10, a middle portion 12, and an upper portion 14. The middle portion 12 extends between the base portion 8 and upper portion 14.

With reference to FIGS. 2-5, the base portion 8 of the sidewall 6 of the bottle 3 is generally cylindrical and includes a curved lower edge 20 that blends into bottom 5. The bottom 5 includes a concave portion 18 that is smaller than the bottom and is substantially centered on the bottom. The top threaded portion 10 of the sidewall 6 is generally cylindrical and has a circular upper edge 21 and external threads 27 spaced below the upper edge 21. In the exemplary embodiment, the top threaded portion 10 of the bottle 3 has a diameter that is less than the diameters of the upper portion 14 and the base portion 8, and slightly more than the diameter of middle portion 12. As a result of the difference in diameter, the upper portion 14 has a region 16 that tapers toward the top threaded portion 10. In the exemplary embodiment, the generally cylindrical sidewall 6 tapers slightly inward as the sidewall transitions between the base portion 8 and the middle portion 12. The sidewall 6 also tapers slightly outward as it transitions between middle portion 12 to upper portion 14. As a result, the generally cylindrical sidewall 6 has a generally "hourglass" shape to facilitate grasping of the bottle 3 by a user (i.e., an infant, young child, caregiver, etc.). It is understood, however, that the diameters of the threaded, upper, middle, and base portions 10, 14, 12, and 8 can be substantially the same diameter or sized other than as illustrated herein.

The exemplary bottle 3 has a liquid chamber 28 configured to hold a quantity of liquid for consumption by the user. More specifically, the exemplary bottle 3 is configured for use by an infant and to hold approximately 8 ounces of liquid (e.g., milk, breast milk, formula, water, juice, etc.). The bottle 3 can be fabricated from any suitable material, e.g., plastic, glass, stainless steel, aluminum, etc. In addition, the bottle 3 can be fabricated in any desired color or color combinations, and may be transparent, translucent, or opaque. In one suitable embodiment, the bottle 3 is constructed from plastic and manufactured using an injection molding process, which provides greater control over the sidewall thickness of the bottle as compared to a blow molding process. It is understood that the bottle 3 can have different configurations than those illustrated herein (e.g., a sports bottle, a travel cup, a training, a sippy cup, etc.), and may be sized to hold quantities of liquid other than 8 ounces (e.g., 2 ounces, 4 ounces, 6 ounces, 12 ounces, etc.).

Figure 6:
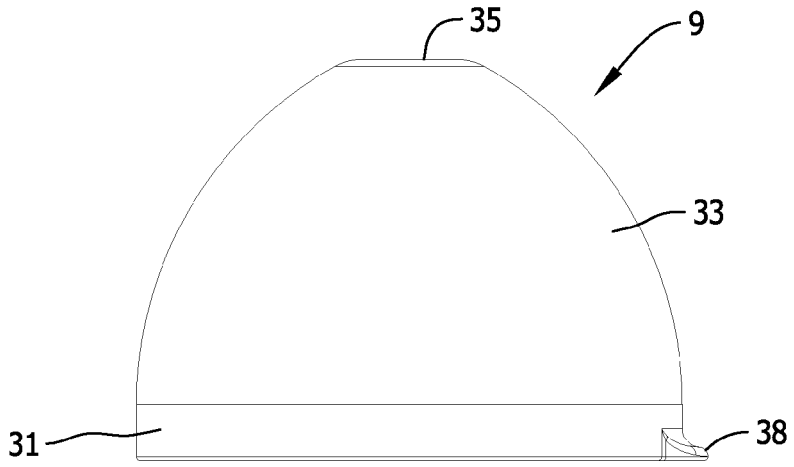
FIG. 6 is a side elevation of a cover for use with the bottle assembly shown in FIG. 1.
Figure 7:
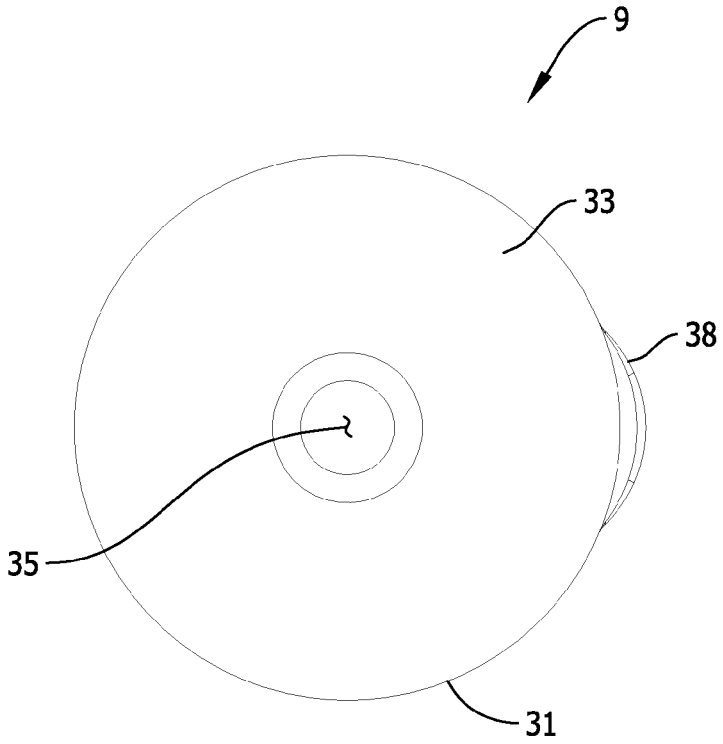
FIG. 7 is a top plan view of the cover shown in FIG. 6.
Figure 8:
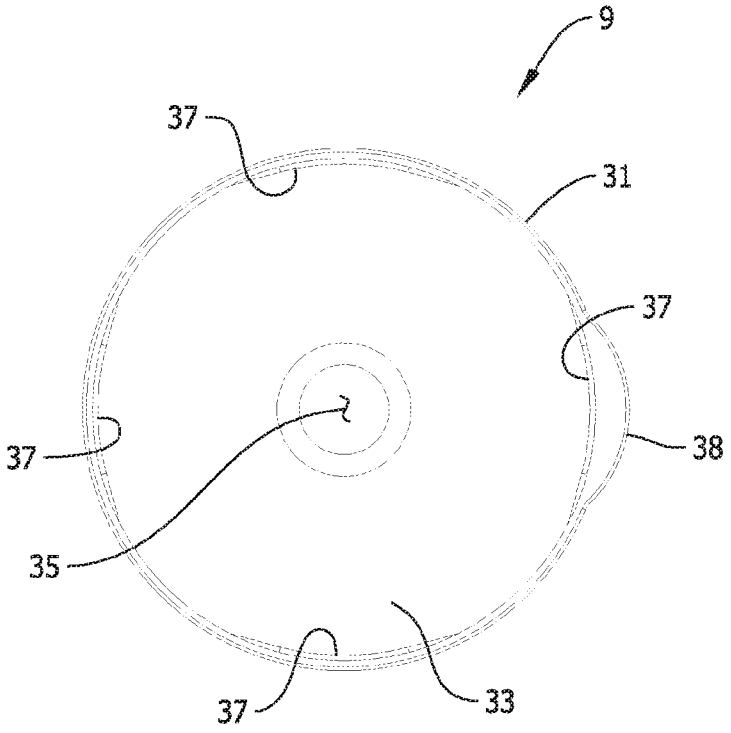
FIG. 8 is a bottom plan view of the cover shown in FIG. 6.
Figure 9:
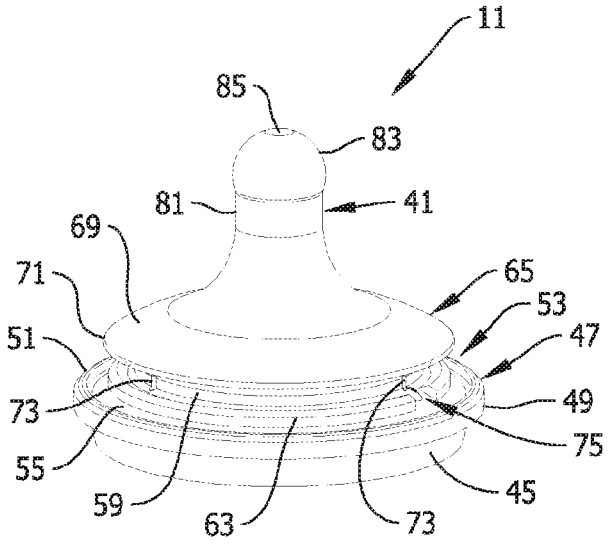
FIG. 9 is a downward looking perspective of a vented nipple for use with the bottle assembly shown in FIG. 1.

With reference to FIGS. 1 and 2, the cover 9 (show in FIGS. 6-8) is removably securable to the collar 13 by a snap-fit connection, but it is understood that other types of suitable connections can be used (e.g., a threaded connection). With reference to FIGS. 2 and 6, the cover 9 has a lower cylindrical portion 31, a domed upper portion 33, and a generally flat top portion 35. As shown in FIG. 8, in the exemplary embodiment, the lower portion 31 has four inward extending tabs 37 adapted for releasable snap-fit connection with the collar 13. As a result, the cover 9 can be selectively secured to the collar 13 during periods of non-use of the bottle assembly 1 (e.g., storage, travel, etc.) to cover the nipple 11 (shown in FIGS. 1 and 2), and selectively removed during periods of use of the bottle assembly 1 for providing access to the nipple 11. In the exemplary embodiment, the four tabs 37 are equispaced about the inner surface of lower portion 31. As shown in FIGS. 6-8, the lower portion 31 also includes an outward extending semicircular tab 38 configured to facilitate selective removal of the cover 9 from the collar 13. In the exemplary embodiment, the tab 38 is located opposite one of the four inward extending tabs 37. Alternatively, the tab 38 can be located in any position along lower portion 31 that enables the cover 9 to function as described herein. The cover 9 can be fabricated from any suitable material, such as polypropylene, and can be made in any desired color or color combinations. In addition, the cover 9 can be transparent (as illustrated), translucent, or opaque. It is contemplated that the cover 9 can be omitted from the bottle assembly 1. It is understood that the cover 9 can have more or fewer tabs 37 than the four seen in the exemplary embodiment.

Referring to FIGS. 2 and 9-12, the nipple 11 is configured to generally resemble a human female's breast to better simulate the feeding of an infant from a breast of a nursing mother. More specifically, the nipple 11 includes a wide base portion 39 and a nipple portion 41 that extends upward from the base portion. The base portion 39 extends upward towards the nipple portion 41 and comprises a generally circular inner surface 43, a substantially planar bottom surface 44, and an outwardly tapering outer surface 45. The base portion comprises an annular flange 47 having a generally circular outer edge 49. The annular flange 47 is spaced from and substantially parallel to the bottom surface 44. In the exemplary embodiment, a continuous, annular lip 51 projects upward from the flange 47 generally adjacent the circular outer edge 49 of the base portion 39. It is understood that the annular lip 51 can be discontinuous (i.e., formed from two or more discrete segments) or even omitted from the base portion 39.

Figure 12:
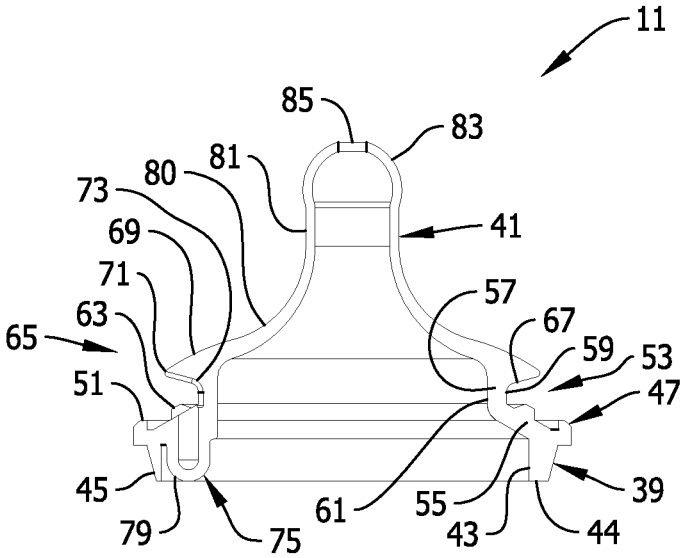
FIG. 12 is a cross-section of the nipple taken along line 12-12 shown in FIG. 10.
Figure 13:
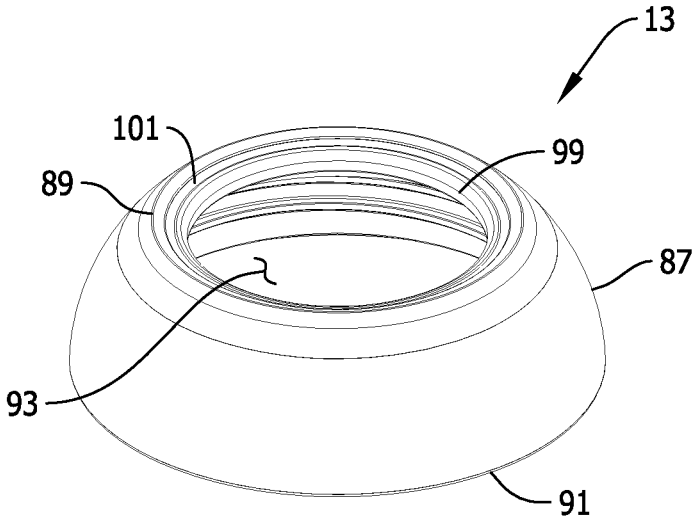
FIG. 13 is a perspective of a collar for use in the bottle assembly shown in FIG. 1.
Figure 14:
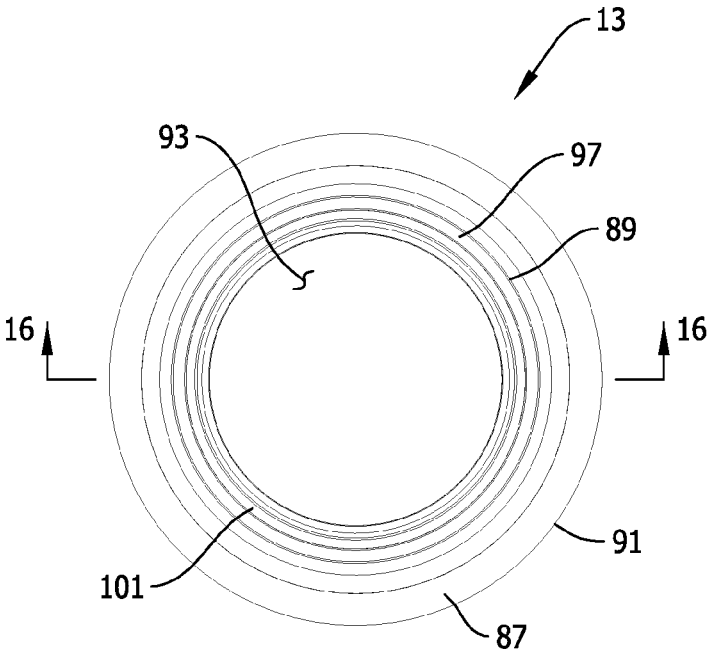
FIG. 14 is a top plan view of the collar shown in FIG. 13.

The nipple 11 comprises a vent region 53 located between the base portion 39 and the nipple portion 41. The vent region 53 extends upward and inward from base portion 39. The vent region comprises an inclined wall 55 that extends upward and inward from the annular lip 51 of the base portion 39 including an inner edge terminating at a generally cylindrical vertical wall 57. The vertical wall 57 includes and outer surface 59 and an inner surface 61. The vent region 53 comprises a generally circular projection 63 that extends outward from inclined wall 55 and is spaced from the annular lip 51 and the vertical wall 57. In the exemplary embodiment, the projection 63 has a generally trapezoidal shape in cross-section, as seen in FIG. 12. It is understood that the projection 63 can be of different cross-sectional shapes (e.g., semi-circular, rectangular, etc.).

Figure 10:
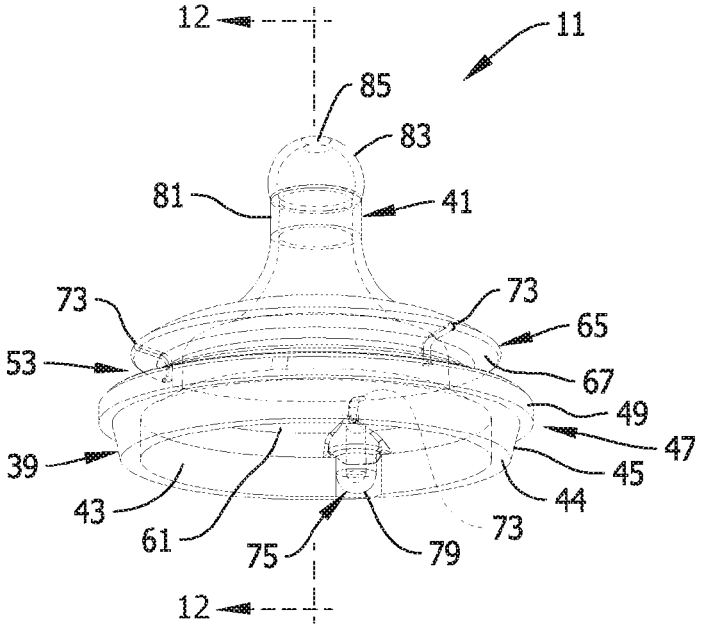
FIG. 10 is an upward looking perspective with hidden lines of the vented nipple shown in FIG. 9.
Figure 11:
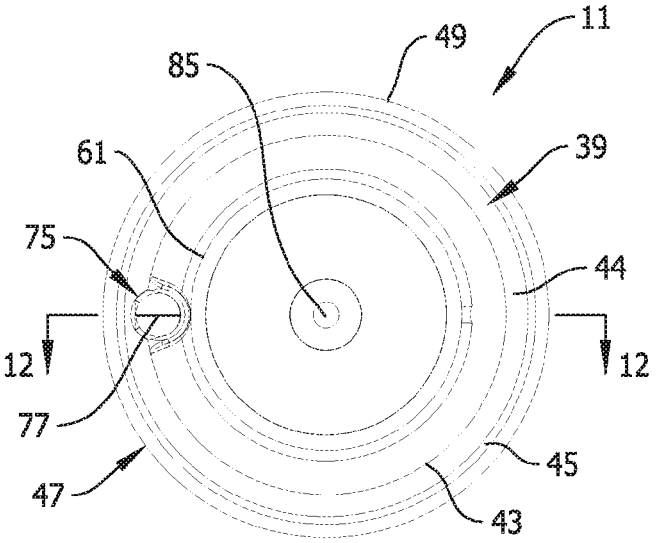
FIG. 11 is a bottom plan view of the nipple shown in FIG. 9.

The vent region 53 comprises an overhang portion 65 that extends radially outward from the top of the vertical wall 57. A lower surface 67 of the overhang portion 65 extends in a generally upward direction. An upper surface 69 extends from an outer edge 71 of the overhang portion 65 in a generally inward and upward direction toward nipple portion 41. As best seen in FIG. 10, the vent region comprises a plurality of semi-circular vent channels 73 formed in the lower surface 67 of the overhang portion 65 and the outer surface 59 of the vertical wall 57. In the exemplary embodiment, nipple 11 comprises three equispaced vent channels 73. Each of the vent channels 73 extends from the outer edge 71 of the overhang portion 65, along the lower surface 67 wherein each transitions to the outer surface 59 of the vertical wall 57. Each of the vent channels 73 extends the length of the vertical wall where each terminates at the transition between the vertical wall 57 and the inclined wall 55.

In the exemplary embodiment, the vent region 53 of the nipple 11 comprises an air valve 75 that extends through and generally vertically downward from the inclined wall 55 toward the base portion 39. The air valve 75 is generally tubular having a slit opening 77 in a bottom dome-shaped portion 79 of the air valve. In the exemplary embodiment, an edge of the air valve 75 is located adjacent the vertical wall 57 and is substantially aligned with one of the vent channels 73. In the exemplary embodiment, the slit opening 77 is a single slit cut through the dome-shaped portion 79 and extending upward through at least a portion of the tubular area of the air valve 75 to a shoulder portion 78 of the air valve. It is understood that the opening 77 can be configured differently, for example, without limitation, a "Y" shaped slit, a cross-cut, or an opening in the form of multiple slits. The shoulder portion 78 is configured to facilitate reducing propagation of the slit opening 77 during cleaning and/or handling of the nipple 11.

The nipple portion 41 of the nipple 11 extends up from the base portion 39 generally adjacent the overhang portion 65 of the vent region 53. As seen in FIG. 12, the nipple portion 41 includes a generally concave sidewall 80 and a generally cylindrical portion 81 extending upward from the concave sidewall. The cylindrical portion 81 includes a generally dome-shaped outlet end 83 that has an aperture 85 for dispensing liquid to a user. The illustrated outlet end 83 has one generally circular aperture 85 therein but it is understood that more openings can be provided in the outlet end and that the openings can have one or more different shapes (e.g., square, triangle, oval, slits, etc.) without departing from the scope of this invention. In the exemplary embodiment, the outlet end 83 has and outer width that is larger than the width of the cylindrical portion 81. It is understood that the width of the dome-shaped end 83 can the same as the cylindrical portion 81.

The nipple 11 may be fabricated from a substantially pliable material, for example, without limitation, a rubber material, a silicone material, or a latex material. It is contemplated, however, that the nipple 11 may be fabricated from any suitable material without departing from the scope of this invention. In the exemplary embodiment, the nipple 11 is suitably transparent or translucent but it is understood that the nipple may instead be opaque.

Figure 15:
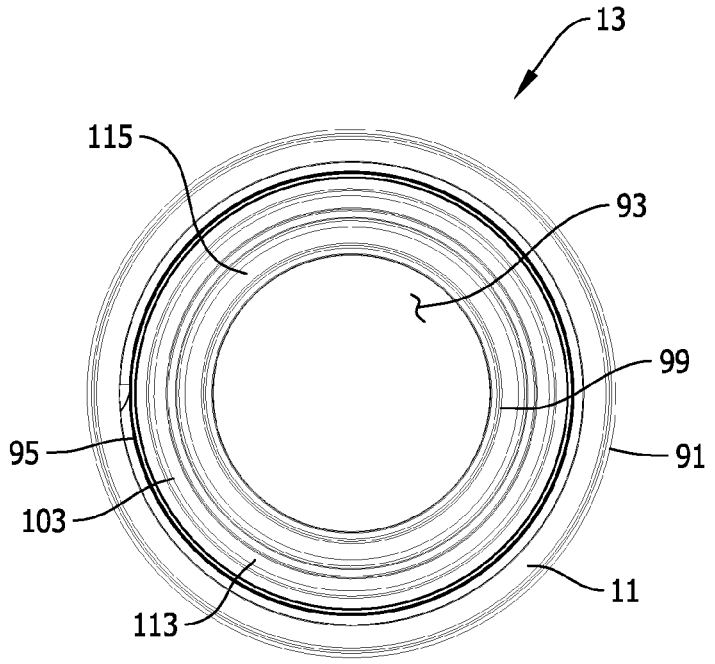
FIG. 15 is a bottom plan view of the collar shown in FIG. 13.
Figure 16:
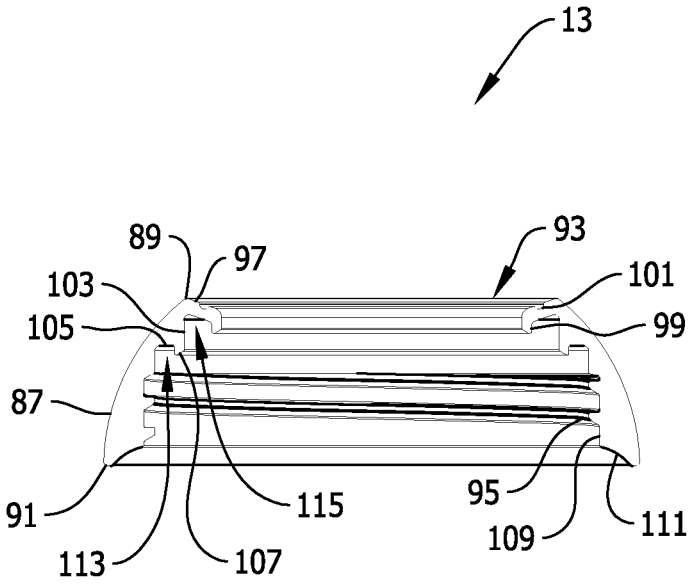
FIG. 16 is a cross-section of the collar taken along line 16-16 shown in FIG. 14.

Referring now to FIGS. 13-16, the collar 13 includes a convex outer surface 87 extending between an upper edge 89 and a lower edge 91. The upper edge 89 includes a generally circular opening 93 therein for allowing the nipple portion 41 of the nipple 11 to pass through the collar 13 as illustrated in FIG. 1. As seen in FIGS. 15 and 16, the collar 13 includes internal threads 95 that are configured to mate to the external threads 27 (See FIG. 2) of the top threaded portion 10 of the bottle 3 for selectively securing the collar 13 and the nipple 11 to the bottle assembly 1. An upper wall 97 of the collar 13 declines downward and inward from upper edge 89. An annular vertical wall 99 extends downward from the declined upper wall 97 and defines the opening 93 in the collar 13. An annular air vent groove 101 is defined in the upper wall 97 and is spaced from the upper edge 89 and the vertical wall 99. As seen in FIG. 16, the air vent groove 101, in cross-section, is semi-circular in shape. It is understood that the air vent groove 101 can be of different cross-sectional shapes (e.g., trapezoidal, rectangular, etc.).

Spaced radially outward from the vertical wall 99 is an annular retaining wall 103 that extends downward from the outer surface 87 of the collar 13. Radially outward of the retaining wall 103 is a substantially horizontal surface 105 spaced upward from an angled lower end 107 of the retaining wall 103. The surface 105 extends radially outward from the retaining wall 103 to a threaded portion 109 including the internal threads 95. The threaded portion 109 is generally cylindrical in shape and extends downward from the outer surface 87 of the collar and terminates as predefined distance above lower edge 91. As seen in FIG. 16, the threaded portion 109 is radially inward from the outer surface 87 such that a concave surface 111 is defined therebetween. In addition, the collar 13 includes a first annular channel 113 defined by surface 105 between retaining wall 103 and threaded portion 109, and a second annular channel 115 defined by upper wall 97 between vertical wall 99 and retaining wall 103.

With reference to FIG. 2, in the exemplary embodiment, the nipple 11 and the collar 13 collectively define a top closure assembly 117 for closing the open top 7 of the bottle 3. It is contemplated that the top closure assembly 117 can have a different configuration than that illustrated herein. For example, the top closure assembly 117 can have any configuration suitable for used with, e.g., a nursing bottle, a sports bottle, a travel cup, a training cup, and/or a Sippy cup.

Figure 17:
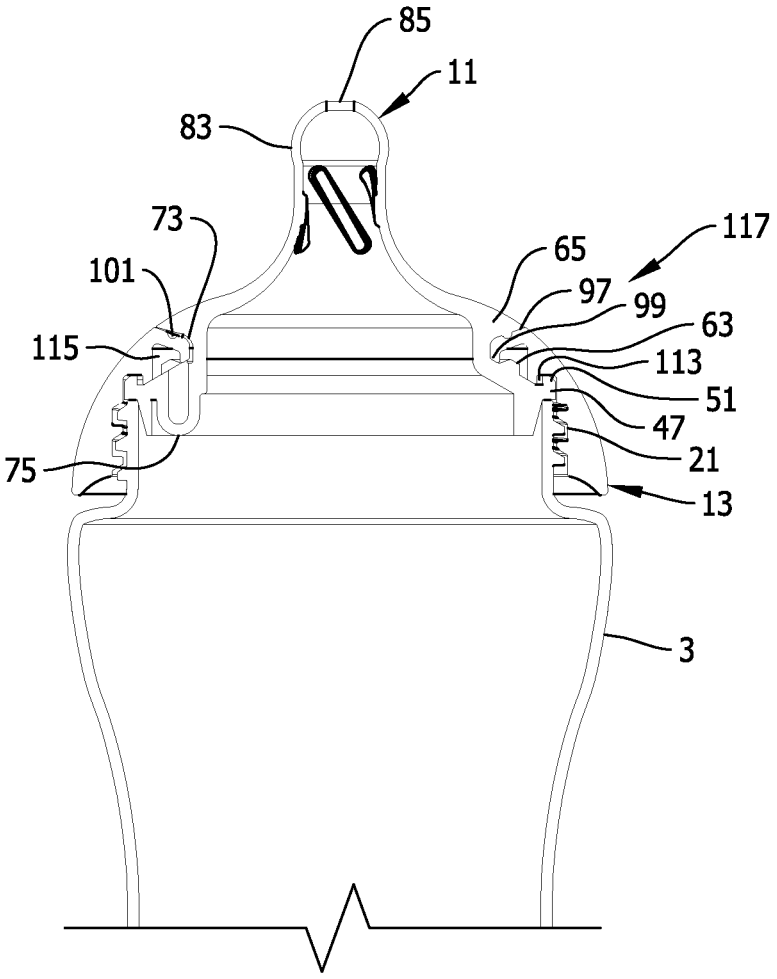
FIG. 17 is a vertical cross-section of the assembled bottle assembly shown in FIG. 1, shown without the cover.

As illustrated in FIG. 17, to assemble the top closure member 117, the nipple 11 is pulled, outlet end 83 first, up through the opening 93 in the upper wall 97 of the collar 13. To facilitate preventing the nipple 11 from being pulled entirely through the opening 93, as the nipple 11 is pulled upward through the opening 93, the annular lip 51 of the nipple catches on the lower end 107 of the retaining wall 103 and is caught in the first annular channel 113 of the collar. Occurring substantially simultaneously, the projection 63 of the nipple 11 catches on the vertical wall 99 and is caught in the second annular channel 115 of the collar. In addition, the overhang portion 65 is pulled entirely through the opening such that it is positioned against the outer surface of the upper wall 97 of the collar 13. Thus, in the assembled configuration, the declined upper wall 97 and the annular vertical wall 99 of the collar 13 is clutched within the vent region 53 of the nipple 11, i.e. between the overhang portion 65, the inclined wall 55, and the vertical wall 57. The projection 63 is positioned within the second annular channel 115 and the annular lip 51 is positioned in the first annular channel 113, whereby they may cooperate with the vertical wall 99 and the retaining wall 103 of the collar, respectively, to properly position the nipple 11 within the collar 13.

In the exemplary embodiment, top closure assembly 117 is attached to the bottle 3 by threadably engaging the internal collar threads 95 with the external threads 27 of the top threaded portion 10 of the bottle 3 to twist the collar 13 down onto the bottle 3. As the collar 13 is tightened onto the bottle 3, the flange 47 of the nipple 11 is urged against the upper edge 21 of the bottle 3 in part by the retaining wall 103 of the collar 13. More specifically, the angled lower end 107 of the retaining wall 103 contacts the inclined wall 55 of the nipple 11 and urges the flange 47 against the upper edge 21 of the bottle 3. In addition, horizontal surface 105 contacts the annular lip 51 of the nipple and facilitates urging flange 47 against the upper edge 21 of the bottle 3. As the flange 47 is pinched between the collar 13 and the bottle 3, it forms a substantially liquid tight seal between the top closure assembly 117 and the bottle 3.

The bottle assembly 1 can be repeatedly taken apart for thorough cleaning (See FIG. 2) and reassembled for the next use (See FIG. 1). The separable components of the bottle assembly 1 are all relatively large so that they are easy to handle, are not easily lost, and pose a reduced risk of danger to small children. In addition, the number of separable components is minimized to make assembly and reassembly of the bottle assembly 1 relatively easy.

As mentioned above, the cover 9 can be selectively removed from the bottle assembly 1 via a snap-fit connection with the collar 13. With reference to FIG. 16, the lower edge 91 of the collar 13 is sized for receiving the tabs 37 of the cover 9 when the cover is secured thereto. The tabs 37 of the cover 9 and the lower edge 91 of the collar 13 collectively define the snap-fit connection therebetween. Thus, a user of the bottle assembly can remove the cover 9 by manually pulling the cover off of the collar 13. The tab 38 is configured to facilitate selectively removing the cover 9 from the collar 13. The collar 13 can be removed from the bottle assembly 1 by disengaging the threaded connection between the collar and the bottle 3. More specifically, the collar 13 can be manually rotated with respect to the bottle 3 to thereby disengage the internal threads 95 of the collar from the external threads 27 of the top threaded portion 10 of the bottle 3. Since the nipple 11 is captured by the collar 13, removal of the collar from the bottle assembly 1 results in removal of the nipple as well. Thus, all of the components of the illustrated bottle assembly 1 can be easily separated and cleaned either manually or in a dishwasher. The bottle assembly 1 can be easily reassembled by reversing the disassembling process.

In operation, a user (e.g., an infant or young child) can drink from the bottle assembly 1 by latching onto the outlet end 83 of the nipple 11 with his/her lips. The user sucks to apply a vacuum to the nipple 11 to enable a liquid contain within the liquid chamber 28 to flow through the aperture 85 for consumption by the user. The vacuum pressure applied by the user to enable flow of the liquid from the liquid chamber 28 of the bottle 3 causes an internal vacuum to form within the liquid chamber. That is, the infant drinking liquid from the bottle assembly 1 causes the pressure within the liquid chamber 28 of the bottle 3 to drop below ambient pressure. As a result, the vacuum formed within the liquid chamber 28 of the bottle 3 draws air through the vent region 53 of the nipple 11. More specifically, the internal vacuum causes the opening 77 of the air valve 75 to open thereby enabling air from outside the bottle assembly 1 to enter into the liquid chamber 28, which tends to equalize the pressure within the bottle to the ambient pressure.

As described above, the air valve is substantially aligned with one of the plurality of vent channels 73 such that air can flow from outside the bottle assembly 1 and into the air valve 75. In addition, each one of the plurality of vent channels 73 is in flow communication with the air vent groove 101. Thus, the internal vacuum causes the opening 77 of the air valve to open, thereby drawing ambient air through at least one of the vent channels 73 into the liquid chamber 28 of the bottle 3. User contact with the overhang portion 65 of the nipple 11 may cause the overhang portion to cover or close one or more of the vent channels 73. In the exemplary embodiment, three vent channels 73 are equispaced about the nipple 11, thereby reducing the chance that all vent channels would be closed at the same time during use of the bottle assembly. Because each of the vent channels is in flow communication with the air vent groove 101 of the collar, air entering any of the vent channels 73 can flow to the air valve 75, either directly into the air valve via the aligned vent channel, or via the air vent groove of the collar. As the vacuum pressure within the liquid chamber 28 of the bottle 3 approaches ambient pressure, the opening 77 of the air valve 75 closes, moving to the sealed position thereby preventing further air flow into the liquid chamber.

As various changes could be made in the above constructions and methods without departing from the scope of the invention, it is intended that all matter contained in the above description and shown in the accompanying drawings shall be interpreted as illustrative and not in a limiting sense.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

What is claimed is:

1. A bottle closure assembly comprising:

a bottle defining a liquid chamber for holding a quantity of liquid, the bottle having a bottom, an open top, and a sidewall extending between the bottom and the open top, the sidewall having a top threaded portion defining the open top of the bottle; and a top closure assembly defining a closure for the bottle, the top closure assembly configured for releasable engagement with the top threaded portion of the bottle over the open top thereof, the top closure assembly comprising:

a nipple having an outlet opening for allowing liquid held in the liquid chamber to exit the bottle assembly, and a vent region having a vent channel and an air valve substantially aligned with the vent channel for allowing air to pass into the liquid chamber of the bottle; and a collar having a convex outer surface and an upper wall having a circular opening, the upper wall having an annular air vent groove defined therein, wherein the vent channel is in flow communication with the air vent groove.

2. A nipple for use with a bottle assembly, the nipple comprising:

a base portion having a bottom surface;

a vent region coupled to and extending upward from the base portion, the vent region comprising a vent channel and an air valve substantially aligned with the vent channel, the vent region comprising an inward extending wall that extends at least in part radially inward from the base portion and has an inner edge, a cylindrical vertical wall that extends upward from the inner edge of the inward extending wall, the cylindrical vertical wall having an outer surface, and an overhang portion extending outward from a top of the vertical wall, the overhang portion having an upper and a lower surface, the vent channel being formed in and extending continuously along the lower surface of the overhang portion and the outer surface of the cylindrical vertical wall; and a nipple portion extending upward from the vent region and having an outlet opening therein.

3. The nipple as set forth in claim 2 wherein the base portion comprises a radially outward extending annular flange having a circular outer edge, the annular flange being spaced from the bottom surface of the base portion.

4. The nipple as set forth in claim 3 wherein the annular flange comprises an upward extending peripheral lip adjacent the circular outer edge.

5. The nipple as set forth in claim 2 wherein the inward extending wall comprises an inclined wall that extends upward and inward from the base portion, the inclined wall further comprising an annular projection that extends outward from the inclined wall, the annular projection being spaced from the cylindrical vertical wall.

6. The nipple as set forth in claim 2 wherein the air valve is a tubular-shaped depression that extends substantially vertically downward from the inward extending wall such that an edge of the cylindrical-shaped depression is adjacent the outer surface of the cylindrical vertical wall.

7. The nipple as set forth in claim 2 wherein the air valve comprises a bottom dome-shaped portion having an opening therethrough.

8. A bottle closure assembly comprising:

a nipple having an outlet opening and a vent region, the vent region having a vent channel and an air valve defined therein, the air valve being substantially aligned with the vent channel; and a collar having a convex outer surface and an upper wall having a circular opening, the upper wall having an annular air vent groove defined therein.

9. The bottle assembly as set forth in claim 8 wherein the nipple includes a base portion having a bottom surface and a nipple portion that extends upward from the vent region.

10. The bottle closure assembly as set forth in claim 9 wherein the vent region comprises an inclined wall that extends upward and inward from the base portion, and a cylindrical vertical wall that extends upward from an inner edge of the inclined wall, the cylindrical vertical wall having an outer surface.

11. The bottle closure assembly as set forth in claim 10 further comprising an overhang portion extending outward from a top of the vertical wall, the overhang portion having an upper and a lower surface.

12. The bottle closure assembly as set forth in claim 11 wherein the vent channel is formed in the lower surface of the overhang portion and the outer surface of the cylindrical vertical wall.

13. The bottle closure assembly as set forth in claim 12 wherein the air valve is a tubular-shaped depression that extends substantially vertically downward from the inclined wall such that an edge of the cylindrical-shaped depression is adjacent the outer surface of the cylindrical vertical wall.

14. The bottle closure assembly as set forth in claim 13 wherein the collar comprises an annular vertical wall that extends downward from the upper wall and defines the opening in the collar, and a retaining wall spaced radially outward from the vertical wall and extending downward from the convex outer surface, the vertical wall and the retaining wall defining an annular channel therebetween.

15. The bottle closure assembly as set forth in claim 14 wherein the nipple is releasably coupled to the collar such that a bottom edge of each one of the vertical wall and the retaining wall of the collar contact the inclined wall of the vent region of the nipple, wherein the nipple air valve is in flow communication with the annular channel of the collar.

16. The bottle closure assembly as set forth in claim 12 wherein the nipple is releasably coupled to the collar such that the overhang portion of the nipple overlies the upper wall of the collar in face-to-face contact such that the vent channel is in flow communication with the vent groove of the collar.

17. The bottle closure assembly as set forth in claim 8 wherein the collar comprises internal collar threads.

* * * * *